United States Patent [19]

Mitchell et al.

[11] 3,974,838

[45] Aug. 17, 1976

[54] SMOKING MATERIALS

[75] Inventors: Terence G. Mitchell, Romsey; John A. Pritchard, Southampton, both of England

[73] Assignee: Brown & Williamson Tobacco Corporation, Louisville, Ky.

[22] Filed: Feb. 6, 1975

[21] Appl. No.: 547,459

Related U.S. Application Data

[63] Continuation of Ser. No. 366,748, June 4, 1973, abandoned.

[52] U.S. Cl. ..... 131/17 R; 131/141

[51] Int. Cl.[2] ..... A24B 3/12

[58] Field of Search ..... 131/2, 140, 141, 142 A, 131/17 R

[56] References Cited

UNITED STATES PATENTS

| | | | |
|---|---|---|---|
| 1,331,331 | 2/1920 | Erslev | 131/141 |
| 3,106,209 | 10/1963 | Torigian | 131/2 |
| 3,747,608 | 7/1973 | Gravely et al. | 131/141 |
| 3,845,774 | 11/1974 | Tso et al. | 131/141 |

*Primary Examiner*—Robert W. Michell
*Assistant Examiner*—V. Millin
*Attorney, Agent, or Firm*—Finnegan, Henderson, Farabow & Garrett

[57] ABSTRACT

The invention is concerned with a process for improving the smoking properties of a tobacco smoking material in which the tobacco material is subjected to treatment with at least one amylolytic enzyme capable of converting the starch contained in the tobacco into sugar. The amylolytic enzyme or a source thereof may be added to the tobacco material, for example to an aqueous dispersion of the latter.

13 Claims, No Drawings

SMOKING MATERIALS

This is a continuation of application Ser. No. 366,748, filed June 4, 1973, now abandoned.

This invention concerns improvements relating to tobacco and reconstituted tobacco and seeks especially to improve the smoking properties of tobacco smoking materials.

Many different types of tobacco plants are grown commercially and a variety of so-called "curing" methods are used in order to obtain tobacco which is suitable for smoking, for example having an acceptable flavour. The known curing methods may be divided into two groups; flue-curing and air-curing.

For flue curing, leaves are placed in a barn in which the temperature and humidity are controlled by ventilation and the application of warm air. When the desired changes have occurred, the leaves are subjected to additional heat to prevent further change in their properties. A characteristic of flue-cured tobacco is that the starch of the uncured leaf is largely converted into soluble sugars.

In air-curing, the leaves are dried either in a barn or by exposure to the sun. In either case, it is a slow drying process in which the starch of the uncured leaf is converted into sugars and then further metabolized so that the dry leaf is usually characterised by a very low content of both starch and sugars.

With both methods, the final contents depend to some extent on the starch content of the tobacco leaves.

Different tobaccos cured by different methods give, on smoking, marked differences in the flavour and composition of the smoke.

It is an object of the present invention to provide a simple method of modifying the starch content of uncured tobacco, or further modifying the starch level in cured tobacco, without relying for this purpose on the use of traditional methods of curing. Another object is to provide a simple and economical means for producing a tobacco product having improved smoking properties.

According to the invention, uncured or cured tobacco material is treated with one or more amylolytic enzymes which is, or are, capable of converting the starch contained in the tobacco into sugars. By this means, for instance, the starch content of uncured leaf may be reduced from 35 to 1% in 6–48 hours compared with 2–21 days in traditional curing, depending on the types of tobacco and curing method. Suitable enzymes are, for example, bacterial alpha-amylase, fungal amylase, or fungal amyloglucosidase. In another manner of carrying out the invention, microbial cells or their substrates are used as a source of amylolytic enzymes, such as amylolytic bacteria, for example species of Bacillus or Pseudomonas, actinomycetes, for example Streptomyces, or fungi, for example Rhizopus of Aspergillus.

The one or more enzymes or sources are added to the uncured or cured tobacco material, which may be in the form of an aqueous slurry, tobacco fibres or a tobacco extract, or moistened leaf, shredded or cut leaf, stem or stalk. It may be added to the fresh green tobacco or to uncured material, preferably tobacco which has been dried rapidly after harvesting.

The enzymes may be added in the form of an aqueous liquid or a powder at a temperature of the tobacco material ranging from 20° to 90°C, preferably 30° to 85°C, depending on the individual enzyme, and at a pH ranging from 3.5 to 9, preferably 4 to 7. The period of the treatment varies depending on the type of tobacco material.

Examples of methods of carrying out the invention are as follows:

EXAMPLE I

Rapid-dried, field-grown tobacco was homogenised by maceration in water, using a vortex-mixer fitted with disintegrator screen (a Silverson Model L2R mixer), in the ratio 5 parts by weight of dry tobacco (moisture content 10%) to 100 parts by volume of water. A preparation of bacterial alpha-amylase (Nervanase 10× supplied by ABM Industrial Products Ltd., United Kingdom) was added to the liquid in amounts varying from 0.002 to 0.02 grams per gram of dry tobacco and the whole was raised to a temperature of 70°C. The starch content (% by dry weight) determined on the untreated tobacco and on the enzyme—treated tobacco was as follows:

| Time after Treatment hours | Concentration of added enzyme (g/g dry tobacco) | | | | |
|---|---|---|---|---|---|
| | 0 | 0.001 | 0.002 | 0.004 | 0.02 |
| 0 | 25 | 24% | 25% | 24% | 25% |
| 2 | 23 | 9 | 10 | 4 | 3 |
| 4 | 26 | 5 | 8 | 4 | 2 |
| 24 | 23 | | 6 | | 1 |

EXAMPLE II

Rapid-dried tobacco was homogenised as in Example I, heated at 100°C for 10 minutes and cooled to 50°C. Fungal alpha-amylase (Amylozyme B300 supplied by ABM Industrial Products Ltd.) was added in amounts ranging from 0.004 to 0.02 g/g dry tobacco. The starch content determined on the sample was as follows:

| Time hours | Concentration of added enzyme (g/g dry (tobacco) | | |
|---|---|---|---|
| | 0 | 0.004 | 0.02 |
| 0 | 25% | 25% | 26% |
| 2 | 18 | 6 | 7 |
| 4 | 28 | 10 | 6 |
| 6 | 25 | 9 | 7 |
| 24 | 23 | 10 | 7 |

EXAMPLE III

Rapid-dried tobacco was homogenised as in Example I, heated at 100°C for 10 minutes and cooled to 65°. Fungal amyloglucosidase (Ambazyme LE50 supplied by ABM Industrial Products Ltd.) was added to the liquid. Limited reduction in starch content was achieved. However, the soluble sugar content as % dry weight was increased, as shown by the following table:

| Time hours | Concentration of added enzyme (g/g dry tobacco) | | | | | |
|---|---|---|---|---|---|---|
| | 0 | | 0.02 | | 0.2 | |
| | Starch | Glucose | Starch | Glucose | Starch | Glucose |
| 0 | 40% | 4% | 34% | 4% | 34% | 4% |
| 2 | 37 | 4 | 40 | 15 | 23 | 15 |
| 4 | 48 | 4 | 35 | 16 | 17 | 15 |

-continued

| Time hours | Concentration of added enzyme (g/g dry tobacco) 0 Starch | 0 Glucose | 0.02 Starch | 0.02 Glucose | 0.2 Starch | 0.2 Glucose |
|---|---|---|---|---|---|---|
| 6 | 50 | 5 | 27 | 18 | 26 | 16 |

EXAMPLE IV

Rapid-dried uncured tobacco was passed, at about 5% solids in water, through a Sprout - Waldron disc refiner operating with a plate clearance of 0.25 mm and plate speed of 2,000 rpm. The resultant slurry was heated to 75°C and Nervanase 10× (see Example 1) was added at the rate of 0.007 grams per gram of dry tobacco. The slurry was held at this temperature, with constant stirring, for 2 hours, after which the temperature was reduced to 65°C and 0.02 ml of Ambazyme LE 50 (see Example III) per gram of dry tobacco was added. Treatment continued for 3 hours and the water solubles were than removed, by draining and centrifugation, and concentrated by climbing film evaporation. The fibrous insoluble residue was refined by further passage through the disc refiner, with a clearance of 0.025 mm, and was formed into a continuous sheet on a miniature Fourdrinier paper machine. The sheet was then impregnated with the aforesaid concentrated water solubles.

A second reconstituted tobacco sheet was formed in an identical manner from the same starting material, except that the enzyme treatment was omitted. The following starch and sugar contents were determined on the two reconstituted tobacco sheets:

| | Concentration (% dry weight basis) Starch | Sucrose | Fructose | Glucose |
|---|---|---|---|---|
| Reconstituted tobacco Sheet with enzyme treatment | 2.3 | less than 0.2 | 1.6 | 22.8 |
| Reconstituted tobacco sheet without enzyme treatment | 12.0 | less than 0.2 | 2.5 | 2.4 |

EXAMPLE V

Rapid-dried tobacco, homogenised as in Example I, was heated at 100°C for 10 minutes. A culture of *Bacillus polymyxa* NCIB. 8648 (NCIB = National Collection of Industrial Bacteria, Aberdeen, United Kingdom), which had been grown at 30°C for 5 days in nutrient broth, was added to the heated macerate in the ratio of 1 part of culture to 1 part of macerate. Starch determinations in % per dry weight were made on the macerate after incubation at 30° and 50°C for up to 24 hours:

| Temperature | Control 0 hours | Control 4 hours | Control 24 hours | +*Bacillus polymyxa* 0 hours | +*Bacillus polymyxa* 4 hours | +*Bacillus polymyxa* 24 hours |
|---|---|---|---|---|---|---|
| 30° | 25% | 24% | 15.5% | 25% | 13% | 3% |
| 50° | 25 | 23 | 7 | 25 | 5 | 2 |

EXAMPLE VI

A culture of the fungus *Rhizopus stolonifer* was grown in malt extract broth for 7 days at 30°C. An aqueous macerate of rapid-dried tobacco was prepared and heated at 100°C as in Example V. The macerate was cooled, mixed with equal parts of the culture of Rhizopus and incubated at 30° and 50°C to effect a reduction in the concentration of starch. Similarly treated macerate, but without Rhizopus, was prepared as a control. The results obtained were as follows:

| Temperature | % starch (dry weight basis) after incubation for: 4 hours Control | 4 hours +Rhizopus | 24 hours Control | 24 hours +Rhizopus |
|---|---|---|---|---|
| 30°C | 22% | 32% | 22% | 3% |
| 50°C | 20 | 6 | 24 | 8 |

EXAMPLE VII

A culture of the actinomycete *Streptomyces griseus* NCIB 8136 was grown in nutrient broth for 7 days at 30°C. The culture was added in equal parts to a heated macerate of rapid-dried tobacco, as in Example VI, and held at 30°, 50° and 70°C to obtain a reduction in the concentration of starch. The results obtained were as follows:

| Temperature | % starch (dry weight basis) after incubation for: 4 hours Control | 4 hours + *Streptomyces griseus* | 24 hours Control | 24 hours + Streptomyces *griseus* |
|---|---|---|---|---|
| 30°C | 32% | 21% | 21% | 11% |
| 50°C | 31 | 26 | 20 | 16 |
| 70°C | 25 | 18 | 26 | 12 |

EXAMPLE VIII

Uncured Virginia tobacco was subjected to three hot soaks at 100°C with a water to tobacco ratio of 15:1. The residue was beaten in a batch-type paper beater (Valley beater) for 10 minutes at 3.3% consistency.

The extract from the tobacco was concentrated on a climbing film evaporator to 11% solids and treated with the enzyme preparation Nervanase 10× (See Example I) at a concentration of one part of enzyme to 50 parts of starch in the extract at pH 6.0. The extract, with the enzyme, was heated with continuous stirring at 70°C for 4 hours.

The residue was treated with enzyme under the same conditions as the extract and used to prepare reconstituted hand-sheets. The treated extract plus extract generated from the treated residue was used to coat the hand-sheets. After drying of the sheets, the starch content of the enzyme-treated sheets was 2.1% compared with 24.5% for sheets prepared without the enzyme treatment.

EXAMPLE IX

Cured Virginia tobacco in a blend in shredded form containing 5% starch by dry weight of tobacco, at 30% moisture content and pH 5.5, was treated with the aforesaid enzyme preparation Nervanase 10× at a concentration of one part enzyme to 50 parts starch in the tobacco. The tobacco was heated to 70°C and held at that temperature for 24 hours, when the starch content was found to be reduced to 1%.

We claim:

1. A process for reducing the starch content of dried uncured tobacco and thereby improving the smoking properties of a tobacco smoking material comprising the steps of:

a. preparing an aqueous slurry of crushed, uncured tobacco; and b. treating the slurry at a temperature between 20° and 90°C. with from 0.001 to 0.2 grams per gram of dry tobacco of at least one amylolytic enzyme capable of converting the starch contained in the tobacco into sugar.

2. The process of claim 1 in which said enzymes are selected from the group consisting of bacterial alpha-amylases, fungal amylases, fungal amyloglucosidase, and mixtures thereof.

3. A process according to claim 1, wherein an amylolytic enzyme is added to said slurry.

4. A process according to claim 1, wherein a source of the amylolytic enzyme is added to said slurry.

5. A process according to claim 4 wherein the slurry is treated with a culture of the group consisting of *Bacillus polymyxa*, *Rhizopus stolonifer* or *Streptomyces griseus* at a temperature in the range of 30° to 70°C.

6. A process according to claim 1 wherein the treatment of step (b) is carried out at a temperature between 30° and 85°C.

7. A process according to claim 1, wherein the enzyme is alpha-amylase in a concentration in the range of 0.001 to 0.02 gram of enzyme per gram of dry tobacco and the treatment of step (b) is carried out at a temperature in the range of 50° to 75°C.

8. A process according to claim 1, wherein the enzyme is amyloglucosidase in a concentration within the range of 0.02 to 0.2 gram of enzyme per gram of dry tobacco and the treatment of step (b) is carried out at a temperature in the range of 50° to 75°C.

9. A process according to claim 8 wherein the slurry is initially held at a higher temperature for a shorter period before the treatment of step (b) is carried out.

10. A process as claimed in claim 1 wherein both alpha-amylase and amyloglucosidase are added to the slurry.

11. A process according to claim 1, wherein the tobacco is rapid-dried tobacco.

12. A tobacco smoking material made in accordance with the process of claim 1.

13. A process according to claim 1, wherein the slurry is held at a temperature of about 100°C. before the treatment of step (b) is carried out.

* * * * *

UNITED STATES PATENT OFFICE

CERTIFICATE OF CORRECTION

Patent No. 3,974,838 Dated August 17, 1976

Inventor(s) Terence G. Mitchell and John A. Pritchard

It is certified that error appears in the above-identified patent and that said Letters Patent are hereby corrected as shown below:

On the first page of the printed patent insert:

--Foreign Application Priority Data: June 20, 1972 - Great Britain No. 28786/72.

Column 2, in Example II, in the chart, change "(g/g dry (tobacco)" to --(g/g dry tobacco)--.

Column 3, line 22, change "than" to --then--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*